US007823753B2

(12) United States Patent
Kovac

(10) Patent No.: US 7,823,753 B2
(45) Date of Patent: Nov. 2, 2010

(54) DOUBLE BARREL CAULKING GUN CADDY

(76) Inventor: Karen S. Kovac, 5708 Dunson Dr., Fort Worth, TX (US) 76148

( * ) Notice: Subject to any disclaimer, the term of this patent is extended or adjusted under 35 U.S.C. 154(b) by 900 days.

(21) Appl. No.: 11/366,271

(22) Filed: Mar. 2, 2006

(65) Prior Publication Data

US 2007/0114248 A1 May 24, 2007

Related U.S. Application Data

(60) Provisional application No. 60/738,126, filed on Nov. 18, 2005.

(51) Int. Cl.
*B65D 88/54* (2006.01)

(52) U.S. Cl. ..... 222/327; 222/1; 222/94; 222/130; 222/325; 222/386; 222/391

(58) Field of Classification Search ..... 222/327, 222/137, 94, 135, 389, 325, 145.1, 145.6, 222/391, 326, 130, 95, 386.5, 567, 568, 546, 222/547, 386.1, 105, 192
See application file for complete search history.

(56) References Cited

U.S. PATENT DOCUMENTS 2,768,768 A * 10/1956 Cornell et. al. ..... 222/80
3,815,791 A * 6/1974 Clark ..... 222/326
4,830,247 A 5/1989 Banks
5,871,106 A 2/1999 Oksa et al.
5,875,920 A * 3/1999 Parent ..... 222/1
6,102,215 A 8/2000 Guida
6,119,903 A * 9/2000 Vanmoor ..... 222/327
6,343,718 B1 * 2/2002 Montenieri et al. ..... 222/326
6,401,988 B1 * 6/2002 Parent et al. ..... 222/326
6,832,797 B1 12/2004 Gassel et al.
7,073,691 B2 * 7/2006 Rumrill et al. ..... 222/391
2005/0006413 A1 1/2005 Miyata et al.
2005/0049558 A1 * 3/2005 Knee et al. ..... 604/218
2007/0095865 A1 * 5/2007 Chick ..... 222/568

* cited by examiner

*Primary Examiner*—Frederick C. Nicolas
(74) *Attorney, Agent, or Firm*—Mark W Handley

(57) ABSTRACT

A caulking gun barrel system fits into caulking guns designed for pre-filled cartridges. The caddy system utilizes soft-sided recharge packs of fill material ordinarily designed for more expensive caulking machines with built-in barrels. The caddy system includes at least one tubular barrel having a removable cap for providing access to the barrel interior for insertion of a recharge pack. A shuttle disposed within the tube articulates between ends of the tube and interfaces between the soft-sided refill pack and the caulking gun piston. Built into the removable cap is an elongate, coaxial nozzle for distributing the fill material. In a preferred embodiment, two such barrels are coupled together by a spine adapted to hold them in linear alignment. After inserting into each barrel a recharge pack opened at one end, a user inserts one of the barrels into a caulking gun and employs its plunger and piston to force fill material out the nozzle. When that recharge pack is spent, the user reverses the barrels to use the other recharge pack in like manner. The system holds the barrels oriented in opposite directions to minimize interference by the spare barrel with use of the caulking gun. The backbone also may include means on its side for holding a smoothing tool commonly employed by users to smooth a bead of the fill material after it has been distributed from the nozzle.

16 Claims, 4 Drawing Sheets

DOUBLE BARREL CAULKING GUN CADDY

This application claims priority from a Provisional Application including the same subject matter, Ser. No. 60/738,126, filed Nov. 18, 2005, and from a Provisional Application including related subject matter, Ser. No. 60/692,872, filed Jun. 21, 2005.

BACKGROUND OF THE INVENTION

1. Field of the Invention

This invention relates generally to caulking guns, and particularly to caulking guns that utilize pre-filled cartridges of caulking, gluing or sealing material. More particularly, it relates to a dual-barrel cartridge caddy that holds two charges of soft-sided fill material packs and allows quick loading replacement of one charge with another, saving operator time and effort.

2. Description of Related Art

Caulking guns, as they are generally known, comprise a class of construction and repair tools that expel caulk, glue, sealant or other fill material with greater precision than likely with trowels, putty knives or the like. Caulking guns usually have a tubular container for the fill material held in a elongate body, with a gun-like hand grip containing controls for operating a piston to push on one end of the container and expel a bead of fill material out the tip of a nozzle on the other end. Two general classes of caulking guns are distinguished largely by whether or not they operate using disposable, pre-filled cartridges with built in nozzles or have fill material cartridges integral with the gun and utilize soft-sided packs. In either case, caulking guns may include pneumatic or hydraulic powered actions to apply pressure to the piston, but most are simple, mechanical devices with a ratcheted plunger that moves the piston in response to squeezing a lever on the hand grip. This invention relates to a caddy having re-useable barrels that allows use of soft-sided fill material packs in guns designed for prefilled, replaceable cartridges.

In using a caulking gun of the type contemplated by the present invention, a user selects and inserts a pre-filled cartridge into the caulking gun and engages the piston against the butt of the cartridge. As he draws a uniform bead of the material onto the work site with the nozzle, the user applies steady pressure to the piston until it reaches its maximum insertion into the cartridge, whereupon the cartridge has been exhausted and must be replaced. The user then retracts the piston, removes and stows the spent cartridge while reaching for a fresh cartridge which he inserts it into the gun, all with one hand while he holds the gun with the other hand.

Refill cartridges are approximately twelve inches in length and two inches in diameter and, depending upon the material in them, can weigh a significant amount. Especially if the user needs to have several at his disposal for a given job, managing multiple refill cartridges can become cumbersome. Sometimes the user must either carry all the cartridges he needs with him, or descend and re-ascend a ladder to retrieve a fresh cartridge and dispose of a spent one each time he empties a cartridge. Means for easing the cartridge handling and replacement operation would save time and trouble for the user.

For industrial grade caulking guns with built-in barrels, soft-sided refill packs of fill material represent a substantial cost savings over pre-filled cartridges of comparable size. They cannot, however, be used in the more commonplace, less expensive caulking guns which have no barrels and are designed to use disposable cartridges. Means for using soft-sided recharge packs in such caulking guns would prove valuable to many contractors.

SUMMARY OF THE INVENTION

Accordingly, it is an object of this invention to provide means for facilitating refill replacement in caulking guns.

It is another object of this invention to provide means for improved ways to refill caulking guns on a job site.

It is another object of this invention to provide a quick load, double-barreled device which uses soft-sided recharge packs of material in a caulking gun designed for disposable cartridges.

The foregoing and other objects of this invention are achieved by providing a caulking gun barrel system fits into caulking guns designed for pre-filled cartridges. The caddy system utilizes soft-sided recharge packs of fill material ordinarily designed for more expensive caulking machines with built-in barrels. The caddy system includes at least one tubular barrel having a removable cap for providing access to the barrel interior for insertion of a recharge pack. A shuttle disposed within the tube articulates between ends of the tube and interfaces between the soft-sided refill pack and the caulking gun piston. Built into the removable cap is an elongate, coaxial nozzle for distributing the fill material. In a preferred embodiment, two such barrels are coupled together by a spine adapted to hold them in linear alignment. After inserting into each barrel a recharge pack opened at one end, a user inserts one of the barrels into a caulking gun and employs its plunger and piston to force fill material out the nozzle. When that recharge pack is spent, the user reverses the barrels to use the other recharge pack in like manner. The system holds the barrels oriented in opposite directions to minimize interference by the spare barrel with use of the caulking gun. The backbone also may include means on its side for holding a smoothing tool commonly employed by users to smooth a bead of the fill material after it has been distributed from the nozzle.

BRIEF DESCRIPTION OF THE DRAWINGS

The novel features believed characteristic of the present invention may be set forth in appended claims. The invention itself, however, as well as a preferred mode of use and further objects and advantages thereof, will best be understood by reference to the following detailed description of an illustrative embodiment when read in conjunction with the accompanying drawings, wherein:

DETAILED DESCRIPTION OF A PREFERRED EMBODIMENT

Figure 1:
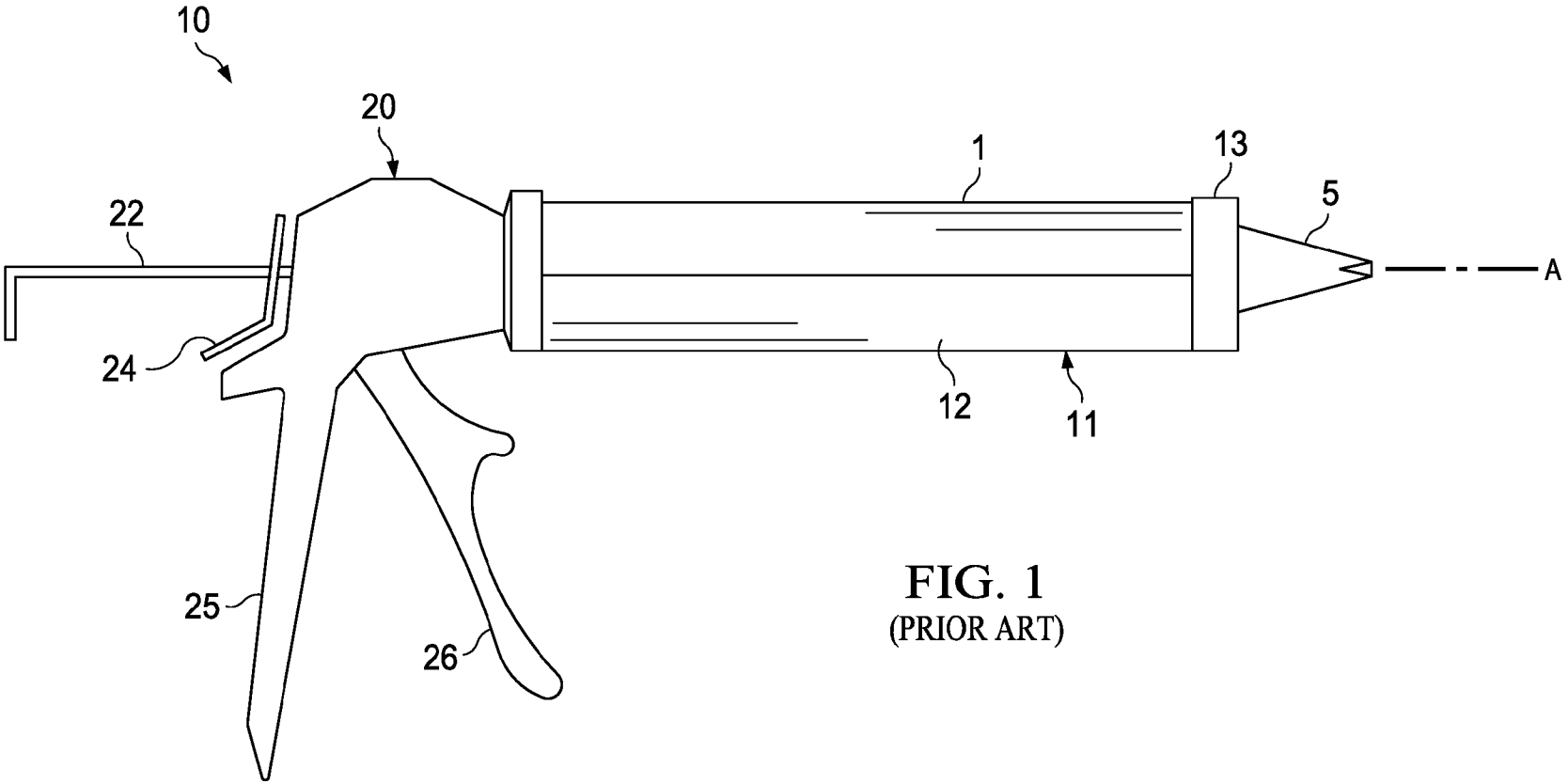
FIG. 1 (PRIOR ART)
FIG. 1 depicts a typical prior art caulking gun with pre-filled fill material cartridge installed.

With reference now to the figures, and in particular to FIG. 1, prior art caulking gun 10 comprises ratchet 20 coupled to the proximate end of cartridge holder 11 by its butt cap 15. Cartridge holder 11 comprises an elongate, cylindrical body 12 extending longitudinally from butt cap 15 to terminate distal ratchet 20 in substantially planar nozzle end cap 13. Though substantially cylindrical, body 12 is not a closed cylinder, but partially surrounds its longitudinal axis A with sufficient opening in its circumference to admit the diameter of pre-filled cartridge 1. End cap 13 includes a slot (not shown) directed upward, away from cartridge holder 11 and adapted to receive and admit nozzle 5 of cartridge 1. Body 12 thus is adapted to admit and hold pre-filled caulking cartridge 1 within body 12 substantially coaxial with axis A and with nozzle 5 protruding through end cap 13.

Butt cap 15 comprises a substantially annular collar closed at its end proximate adjacent ratchet 20 by a planar bulkhead (not shown) through which plunger 22 (see also FIG. 3) extends coaxial with axis A. Cartridge 1's butt end (not shown) nests within butt cap 15 and abuts piston 23 of plunger 22. Piston 23 has a diameter slightly smaller than and resting within a recess (not shown) within the butt end of cartridge 1 typically provided for the purpose. Piston 23 is adapted to apply axial pressure to urge fill material out of cartridge 1 through nozzle 5. Plunger 22 is urged forward by repeated incremental steps induced by squeezing grip lever 26 against handle 25 in a scissors-like grasp adapted to keep steady pressure on the fill material in cartridge 1 as it is emptied by usage. Release 24 permits retraction of plunger 22 when cartridge 1 is exhausted and needs replacing with a fresh cartridge 1.

Figure 2:
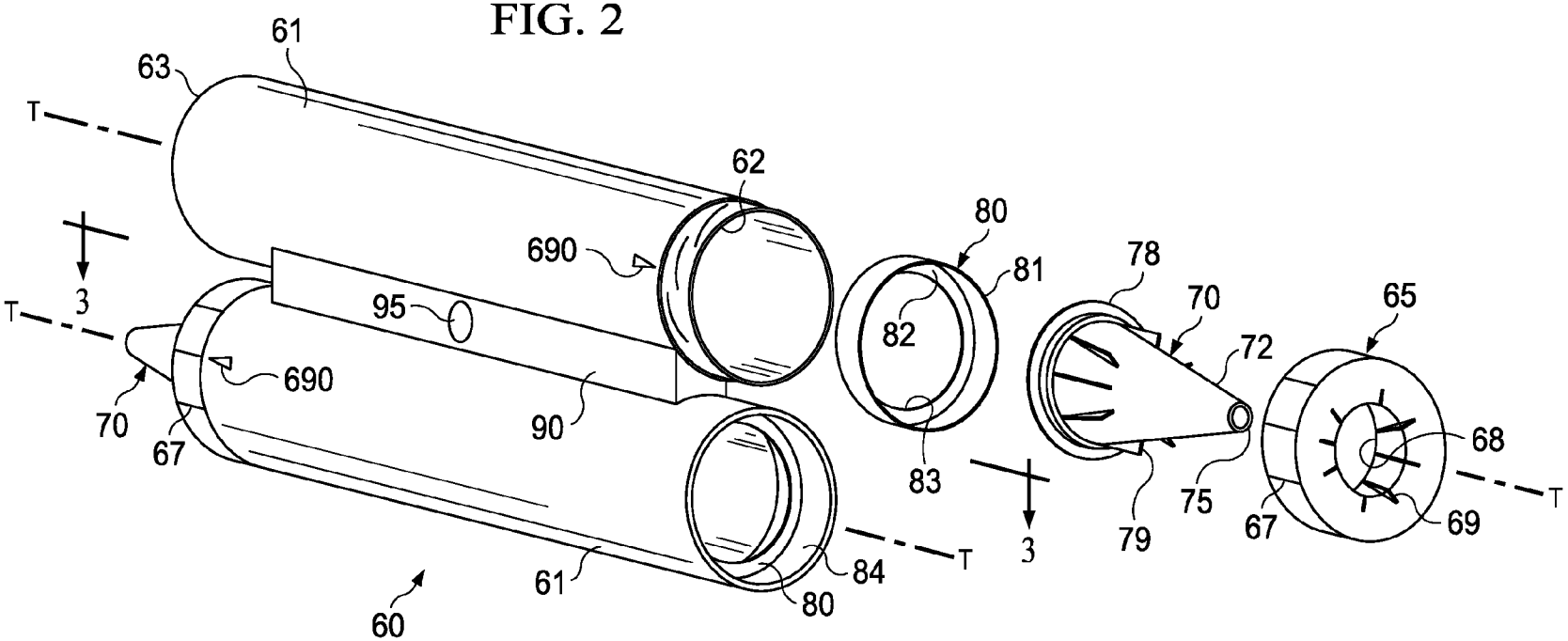
FIG. 2 depicts in perspective a preferred embodiment of the present invention having one barrel thereof axially exploded to reveal its components.
Figure 6:
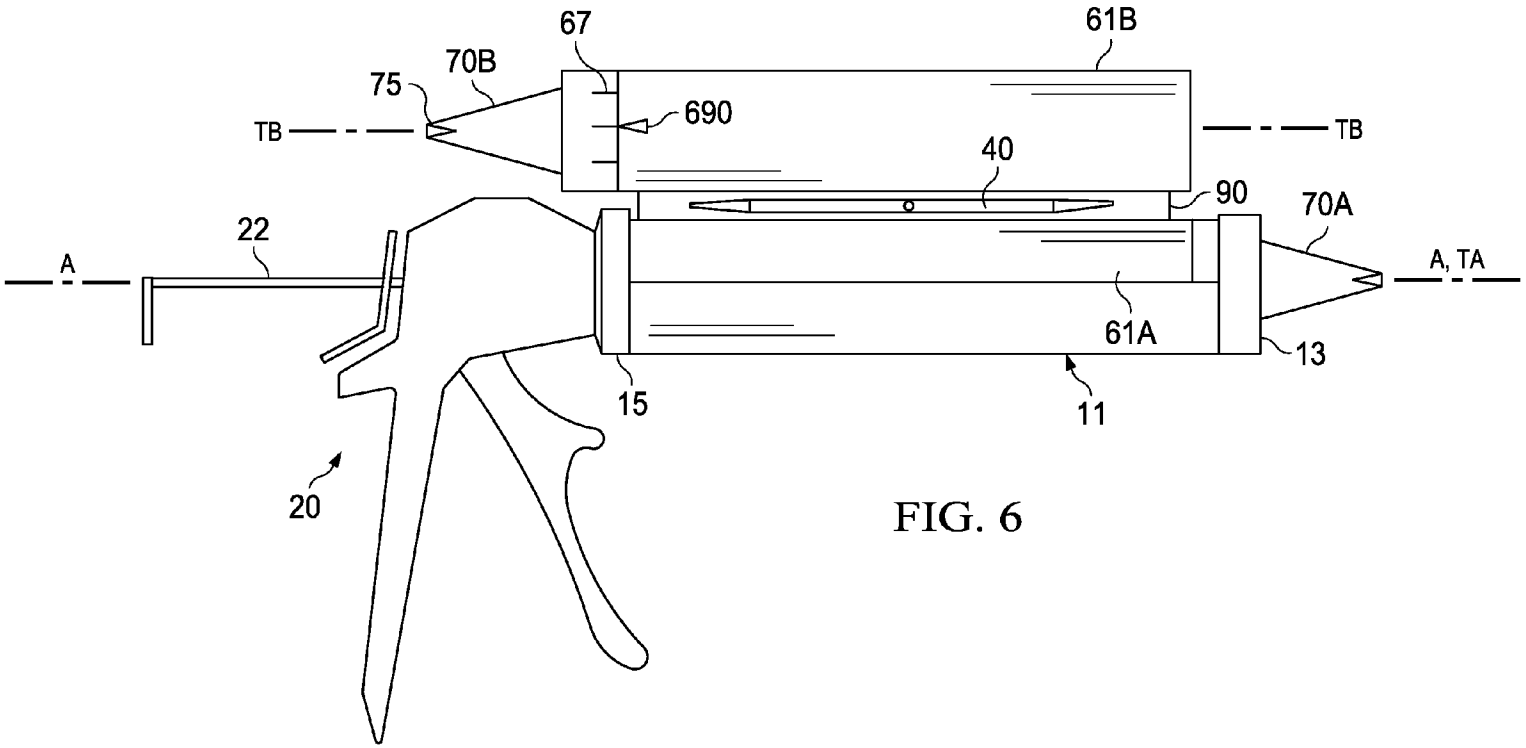
FIG. 6 depicts the present invention installed in the caulking gun of FIG. 1.

Referring now to FIGS. 2 and 6, caddy 60 of the present invention comprises two tubular barrels 61 having parallel longitudinal axes T and coupled together by backbone 90. NOTE: hereinafter as it serves convenience and clarity, references to parts of barrels 61 and caddy 60 employ a suffix "A" or "B" depending upon whether associated with barrel 61A installed within cartridge holder 11 (FIG. 6) or barrel 61B poised atop and ready to replace barrel 61A. Barrels 61A and 61B are disposed parallel and juxtaposed to each other with their nozzles 70 pointing in opposite directions, barrel 61A adapted to be held within cartridge holder 11 while barrel 61B is displaced a small distance above it by backbone 90. Each tubular barrel 61 surrounds coaxial chamber 62 disposed between butt end 63 and nozzle end 64.

Disposed between barrels 61 and coupling them together, backbone 90 comprises a substantially rectangular bar having concave top and bottom edges matching the curvature of and mated to barrels 61. Backbone 90 couples between barrels 61 coplanar with their respective longitudinal axes TA, TB, and preferably creates a separation between barrels 61 in the range of six to eight (6-8 mm) millimeters. At this spacing, nozzle 70B has sufficient clearance to avoid interfering with ratchet 20 over which it extends (FIG. 6), yet barrel 61B is as low as practicable to barrel 61A. In this fashion, where barrel 61A is installed within cartridge holder 11 (FIG. 6), barrel 61B is disposed directly atop cartridge holder 11 and substantially coplanar with handle 25. Said another way, spare barrel 61B is perched directly atop installed barrel 61A but with its nozzle 70B extending toward and partially above handle 25. This gives a user (not shown) ample visibility of nozzle 70A during usage. Keeping axes TA, TB substantially coplanar with handle 25 keeps caulking gun 10 with caddy 60 in place substantially balanced transversely.

Figure 3:
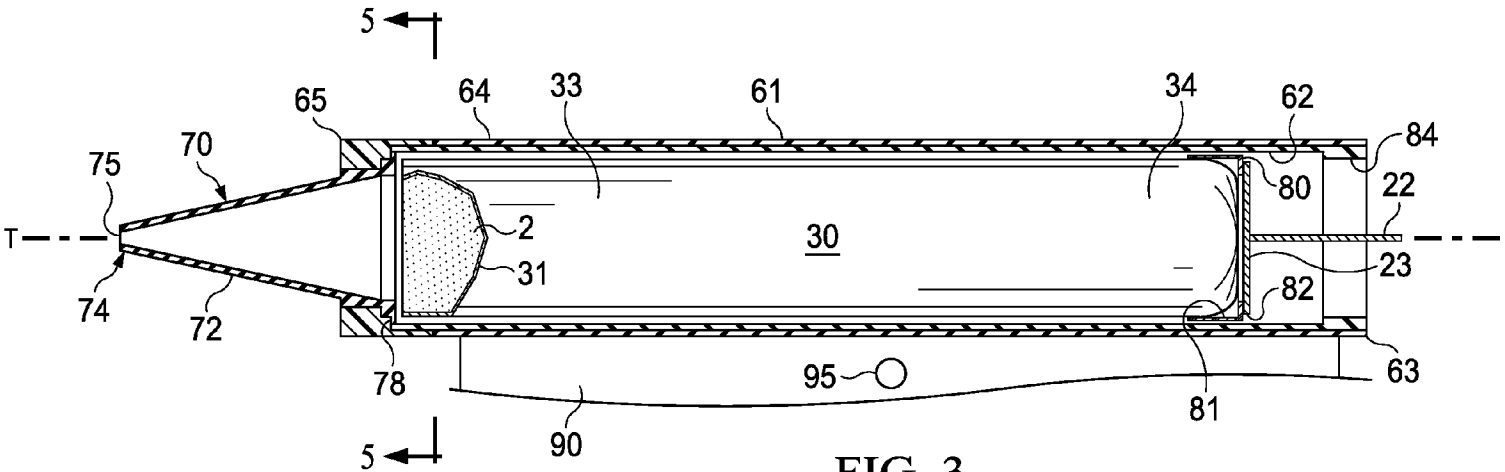
FIG. 3 details in longitudinal cross section as indicated in FIG. 2 the interior of one barrel of the caddy of FIG. 2 with fill material pack installed and partially used.

As best seen in FIG. 3, barrels 61 each are adapted to receive within their interiors 62 one soft-sided refill pack 30, containing fill material 2. Pack 30 comprises a sausage-shaped body having nose 33 and butt 34 and surrounded by membrane 31. Pack 30 is of the same general makeup and type used to refill caulking guns with integral barrels (not shown), namely, industrial guns not adapted to use disposable, pre-filled cartridges 1. As discussed in detail below, caddy 60 utilizes refill packs 30 in a manner whereby packs 30 can replace cartridges 1 in caulking guns 10.

By industry convention, disposable refill cartridges 1 have an outside diameter of forty-nine (49 mm) millimeters. Preferably, the outside diameter of barrel 61 is substantially the same as disposable cartridges 1 such that it will nest within tube holder 11 of caulking gun 10. Further, refill packs 30 conventionally have an outside diameter of approximately 43 mm, and barrel 61 has an inside diameter providing ample clearance for easy insertion of pack 30, along axis T. Thus, barrels 61 preferably comprise a thin wall tube having an inside diameter of approximately 47 mm. Alternately, dimensions for barrels 61 are related to those of packs 30, and other sizes for barrels 61 would be appropriate for packs 30 having different diameters. Likewise, cartridge holders 11 of caulking guns 10 also would have to be correspondingly larger. One having ordinary skill in the art will recognize that all such variations are considered within the spirit and scope of the present invention.

Barrels 61 comprise a resilient material having sufficient geometric stability and elasticity to hold their shape under the pressure of piston 23 applying pressure to expel fill material 2. Suitable materials for this purpose are thin wall, sheet steel of 22 gauge or thicker, and various thermoplastic substitutes therefor. Wall thickness of barrels 61 therefore depends upon the material selected, and one having ordinary skill in the art will recognize that all such variations and options are considered within the spirit and scope of the present invention. A suitable thermoplastic material for caddy 60 is two (2 mm) millimeter thick styrene or polyethylene tubing cut to length and mated with caps 65.

Disposed within interior 62 of tube 61 near butt end 63, shuttle 80 articulates longitudinally between ends 63, 64 as fill material 2 within chamber 62 is urged out through nozzle 70. Shuttle 80 embraces butt 34 of pack 30 while it is urged axially toward nozzle 70 in response to pressure from piston 23. Shuttle 80 comprises substantially cylindrical, annular ring 81 with concentric shelf 82 disposed on its end closest tube 61's butt end 63. Ring 81 has an outer diameter adapted to be received snugly within interior 62 of each tube 61. Ring 81 may be a simple, regular cylinder concentric with the interior surface of tube 61, but ring 81 preferably flares toward nozzle end 64 of tube 61. This flare increases slightly its diameter for assuring a snug fit within interior 62 and to prevent fill material 2 or portions of membrane 31 from leaking past ring 81 under pressure while allowing its shelf 82 end easily to be inserted into nozzle end 64 of tube 61.

Extending radially inward from ring 81 sufficiently to overlap piston 23, shelf 82 provides a substantial surface against which piston 23 bears during operation. The inner margin of shelf 82 forms opening 83, which allows air to escape from interior 62 to prevent unwanted pneumatic pressure from causing unnecessary resistive force against plunger 22. Shelf 82 and opening 83 may comprise alternate configurations to that depicted, such as a continuous bulkhead normal to axis T and interrupted with smaller openings (not shown) shaped as simple round holes, slots or the like. One having ordinary skill in the art will recognize that all such means of allowing air to escape are considered within the spirit and scope of the present invention.

Disposed within butt end 63 of tube 61, annular stop ring 84 affixed to tube 61 provides a solid jamb against which shuttle 80 may bear when it is fully retracted from nozzle end 64 and ready to receive a fresh refill pack 30. Stop ring 84 prevents shuttle 80 from being pushed out of tube 61. Stop ring 84's interior diameter is sufficiently large, however, to admit piston 23 extending therethrough to engage shelf 82 of shuttle 80.

As best seen in FIG. 3, shuttle 80 progresses under pressure from piston 23 longitudinally along tube 61 toward nozzle end 64, thereby urging fill material 2 out through nozzle 70. Shuttle 80 further crumples and retains membrane 31 as it collapses toward nozzle 70 as fill material 2 is expended. When shuttle 80 reaches nozzle end 64, the forward edge of ring 81 comes into contact with base 78 of nozzle 70, thereby halting its progress. At this point, most of fill material 2 has been expelled through outfall port 75, with only some residue thereof remaining within cone 72 and the now fully collapsed (not shown) membrane 31. Ring 81 preferably is as short as practicable to minimize waste of fill material 2. Preferably, ring 81 extends no more than one-half (½") inch along tube 61 parallel to axis T.

Figure 5:
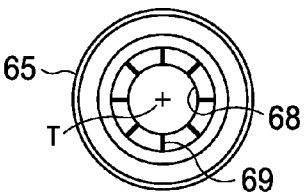
FIG. 5 shows an axial view as indicated in FIG. 3 of the nozzle end cap adapted to engage and hold the nozzle of FIGS. 4A and 4B on a barrel of the present invention.
Figure 4B:
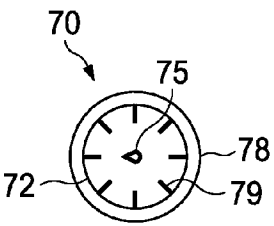
FIGS. 4A and 4B represent side and nozzle end views respectively of the nozzle of the caddy of FIG. 2.
Figure 4A:
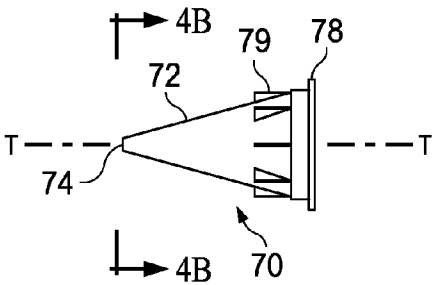

Referring now also to FIGS. 4A, 4B and 5, nozzle 70 extending coaxially from barrel 61 comprises cone 72 tapering from base 78 to terminate in nose 74. Nose 74 further includes outfall port 75 from which fill material 2 extrudes. Outfall port 75 comprises a slanted aperture adapted to enable a user (not shown) to properly direct and shape a bead (not shown) of fill material 2 against a fill site (not shown). Variations in outfall ports 75 for different nozzles 70 may be dictated by fill materials 2 or by the size and shape of a bead (not shown) of fill material to be extruded.

Controlling the orientation of outfall port 75 is important for a user's precision. Cone 72 of nozzle 70 extends through aperture 68 of cap 65 and bears lugs 79 disposed evenly around its exterior surface near base 78. Lugs 79 cooperate with corresponding slots 69 on the interior of cap 65 to secure cone 72 in one of a plurality of axial positions about axis T. Index marks 67 correspond in axial position around cap 65 to the axial positions of slots 69. Index marks 67 are adapted to be matched with position arrows 690 on the exterior of tubes 61 near their nozzle ends 64 (FIGS. 2, 6). Thus, cap 65 and nozzle 70 may be oriented reliably for any axial position of outfall port 75 appropriate for a given job site.

Figure 7:
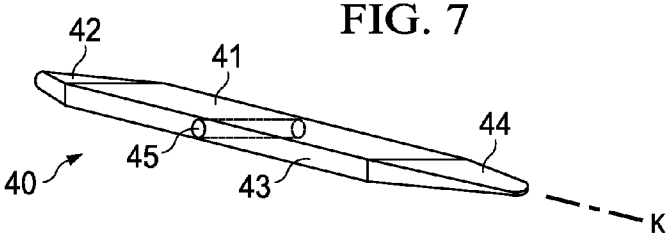
FIG. 7 shows a smoothing tool used with the present invention.

Referring now to FIG. 7, bead smoothing tool 40 comprises a substantially planar, elongate body 41 with side edges 43 and having a tapered smoothing spoons 42, 44 on opposite ends of its longitudinal axis K. Tool 40 comprises one of a relatively common class of such tools used in the caulking and fill material industry, with one exception. Disposed substantially at the longitudinal midpoint of side edge 43, metallic post 45 extends transverse body 41 and axis K to protrude flush with both opposite edges 43. Post 45 preferably is approximately one fourth (¼") inch in diameter and composed of magnetically attractive, usually ferrous, material. Other means of providing magnetically attractive material around the midpoint of tool 40 may be employed, such as a metal collar surrounding body 41, or even making tool 40 entirely of ferrous metal. One having ordinary skill in the art will recognize that all such variations are considered to be within the spirit and scope of the present invention.

Disposed at substantially the midpoint of backbone 90, magnetic insert 95 extends transverse axis T from one side of backbone 90 to the other. Insert 95 magnetically attracts and holds post 45, and thereby tool 40 to one side of backbone 90 between tubes 61 (see FIG. 6). By such magnetic capture, tool 40 is kept handy yet out of the way when a user employs the present invention to distribute a bead of fill material 2 at a job site. Alternate means of achieving such handy capture could be employed, such as attaching resilient fingers adapted to grasp tool 40 by one edge 43 and sufficiently strong to hold it during use of the present invention. One having ordinary skill in the art will recognize that all such means for attaching tool 40 to backbone 90 are considered to be within the spirit and scope of the present invention.

In operation, a user (not shown) prepares caddy 60 by selecting two packs 30 containing the desired fill material 2 for the job at hand. One having ordinary skill in the art will recognize that the two selected packs 30 need not contain the same fill material 2, but in fact could be selected to provide at least two alternate fill materials 2 for simultaneous usage. The user also selects nozzles 70 having outfall ports 75 appropriate for the job and for fill materials 2 and inserts them through apertures 68 and into caps 65. The user then cuts open one end of each pack 30 and inserts one each of selected packs 30 into chambers 62 through nozzle ends 64 of barrels 61 until their butts 34 are juxtaposed shuttles 80. If necessary, packs 30 may be used to push shuttles 80 longitudinally toward butt ends 63 of barrels 61 until packs 30 fit fully within chambers 62.

The user next attaches caps 65 and nozzles 70 onto barrels 61. The user then installs barrel 61A within cartridge holder 11 with nozzle 70A extending through the slot in end cap 13. Barrel 61B may be disposed to one side or the other as much as thirty (30 deg.) degrees off of the plane of handle 25 in gun 10, as preferred by the user, but the most balanced position is directly atop installed barrel 61A coplanar with handle 25, as discussed above. Once this is determined, the user may orient outfall port 75 as desired using index 67.

The user then proceeds to his caulking, sealing or gluing operation by operating gun 10 to force the fill material within barrel 61A out its nozzle 70A using tip 75A to distribute it. The user may use smoothing tool 40 to shape and smooth the resulting bead (not shown) by removing tool 40 from post 95 and then returning it when finished. The user proceeds until barrel 61A is empty or until a different fill material 2 is needed. At that juncture, if barrel 61A is exhausted, plunger 22 will be extended into barrel 61A to its fullest extent. The user first operates release 24 and extracts plunger 22 until piston 23 again is adjacent butt cap 15, thus removing the pressure from barrel 61A. The user then grasps caddy 60 by spare barrel 61B and lifts nozzle 70A until it clears end cap 13. The user then simply rotates caddy 60 within his hand to orient nozzle 70B of spare barrel 61B toward end cap 13 while turning caddy 60 so that he grasps now spent barrel 61A with spare barrel 61B depending toward gun 10. The user inserts butt end 63B of spare barrel 61B into collar 15 and urges nozzle 70B into the slot in end cap 13, thus installing spare barrel 61B into gun 10. The user next pushes piston 23 with plunger 22 until it engages shuttle 80 within barrel 61B, completing the replacement process.

The present invention, described in either its preferred or alternate embodiment, thus serves as a quick load cartridge caddy which saves it's user a great deal of time compared with the traditional cartridge changing operation. The user need not reach into his pocket or other storage for a spare barrel 61B, nor need he dispose of spent barrel 61A, climb up and down a ladder (not shown) or otherwise delay his caulking, sealing or gluing job. Within seconds, he is back at the job, long before the bead of material has dried or cooled. Just as importantly, caddy 60 provides means for utilizing soft-sided refill packs 30 in the ubiquitous caulking gun 10 intended for pre-filled cartridges 1, thus creating a great savings in cost for material 2.

While the invention has been particularly shown and described with reference to one or more embodiments, it will be understood by those skilled in the art that various changes in form and detail may be made therein without departing from the spirit and scope of the invention. For example, caddy 60 has been described in use with a mechanical gun 10, but just as easily could be used with pneumatically or hydraulically driven plungers 22. Additionally, use of the invention was described above as requiring that the user cut open one end of packs 30 before inserting them into barrels 61. Instead, caps 65 could be equipped with one or more cutters (not shown) adapted to penetrate membrane 31 as cap 65 is fitted onto barrel 61, thus liberating fill material 2 within chamber 62 automatically. Also, the caddy system has been discussed herein in the context of two barrels 61 coupled together by backbone 90, but a single barrel 61 and associated nozzle 70 and shuttle 80, without backbone 90, could be employed to utilize soft packs 30 within caulking gun 10, thereby providing the cost savings of soft packs 30 over pre-filled cartridges 1 without also meeting the convenience features of a double-tube caddy system. Alternately, caddy 60 could comprise three of the barrels 61 (not shown) arrayed evenly (120 degrees apart) around backbone 90 (reconfigured to include three curved edges that mate with the three barrels 61). In such case, the barrels 61 need not face opposite directions because each nozzle 70 would be readily visible to the user between the other of the three nozzles 70.

I claim:

1. A caulking gun caddy for a caulking gun, the caulking gun having a body adapted to receive fill material cartridges and having a ratchet head operable to urge a plunger against a butt of the cartridge to expel fill material in a shaped bead, the caddy comprising at least one tubular barrel adapted to be received within the body, the barrel surrounding an interior and having a longitudinal axis extending between a butt end and a nozzle end, a nozzle disposed on the nozzle end, the nozzle having a truncated, conical nose and a cap, wherein the cap is adapted to engage the nozzle end of the barrel with the conical nose extending therefrom and removably secure the conical nose to the nozzle end of the barrel, such that the cap and the truncated, conical nose are removable from the barrel for inserting a refill pack of fill material into the interior of the barrel, a shuttle received within the interior and adapted to articulate between the butt end and the nozzle end, the shuttle having an annular ring disposed coaxial the barrel and having a shelf end oriented toward the butt end;

a shelf disposed on the shelf end and extending radially inward toward the axis to engage the plunger; and a stop means disposed within the interior adjacent the butt end and for limiting travel of the shuttle.

2. The caulking gun caddy according to claim 1 wherein the nozzle further comprises the cap adapted to engage the nozzle end of the barrel such that the cap may rotate about the axis between a plurality of axial positions, the cap having a plurality of position marks disposed parallel the axis on an exterior surface of the cap, the marks adapted to align with a position arrow on an exterior surface of the barrel; and the truncated, conical nose received within the cap having a base end opposite a bead end, the bead end forming a bead aperture;

a plurality of longitudinal vanes disposed evenly around the base end and adapted to engage notches within the cap to affix the nose in one of a plurality of axial positions within the cap.

3. The caulking gun caddy according to claim 1 and further comprising a plurality of said at least one tubular barrel, the barrels disposed adjacent at least one other barrel with their longitudinal axes parallel; and a backbone coupled between the barrels and affixing them a spaced distance apart, each barrel being disposed axially around the backbone equidistant from its adjacent barrels.

4. The caulking gun caddy according to claim 3 wherein two of said at least one tubular barrels disposed parallel each other on opposite sides of the backbone and with their respective nozzle ends directed in opposite directions.

5. The caulking gun caddy according to claim 1 and further comprising two of said at least one tubular barrels disposed parallel to each other with their respective nozzle ends directed in opposite directions; and a backbone coupled between the barrels and affixing them a spaced distance apart.

6. The caulking gun caddy according to claim 5 and further comprising a smoothing tool removably disposed on the backbone, the tool having smoothing spoons on opposite ends of an elongate handle; and coupling means for holding the smoothing tool on the caddy.

7. The caulking gun caddy according to claim 6 wherein the coupling means comprises a ferrous metal post journaled within a recess within the handle; and a magnet disposed within the backbone and adapted to attract and hold the post.

8. The caulking gun caddy according to claim 1 wherein the stop means comprises an annular collar affixed to and coaxial with the interior, the collar surrounding and defining an aperture adapted to admit the plunger, the collar adapted to engage the shelf of the shuttle to prevent it from traveling out the butt end of the barrel.

9. The caulking gun caddy according to claim 1 wherein the interior is adapted to receive a soft-sided refill pack of fill material; and the shuttle adapted to engage a butt of the refill pack with the annular ring disposed between the refill pack and an interior surface of the barrel; and the shelf disposed between the butt of the refill pack and the plunger wherein the plunger bears against the shelf to urge the butt of the refill pack toward the nozzle to expel the fill material through the bead aperture.

10. A caulking gun caddy for a caulking gun, the caulking gun having a body adapted to receive fill material cartridges and having a ratchet operable to urge a plunger against one end of the cartridge to expel fill material from an opposite end of the cartridge, the caddy comprising two tubular barrels each adapted to be received within the caulking gun, each barrel having an interior surrounding a longitudinal axis extending between a butt end and a nozzle end, the interior adapted to receive a soft-sided refill pack of fill material;

nozzle means on the nozzle end;

a shuttle received within the interior and adapted to engage a butt of the refill pack and to articulate between the butt end and the nozzle end, the shuttle having an annular ring disposed coaxial the barrel and having a shelf end oriented toward the butt end;

a shelf disposed on the shelf end and extending radially inward toward the axis to engage the plunger; and an annular collar affixed to and coaxial with the interior, the collar surrounding and defining an aperture adapted to admit the plunger, the collar adapted to engage the shelf of the shuttle to prevent it from traveling out the butt end of the barrel; and a backbone coupled between the barrels to hold them a spaced distance apart with their axes parallel and with their nozzles disposed in opposite directions.

11. The caulking gun caddy according to claim 10 and further comprising a smoothing tool removably disposed on the backbone, the tool having smoothing spoons on opposite ends of an elongate handle; and a ferrous metal post journaled within a recess within the handle; and a magnet disposed within the backbone and adapted to attract and hold the post.

12. The caulking gun caddy according to claim 10 wherein the nozzle means comprises a cap journaled onto the nozzle end of the barrel and adapted to rotate about the axis between a plurality of axial positions, the cap having a plurality of position marks disposed parallel the axis on an exterior surface of the cap, the marks adapted to align with a position arrow on an exterior surface of the barrel; and a truncated, conical nose received within the cap and having a base end opposite a bead end, the bead end forming a bead aperture;

a plurality of longitudinal vanes disposed around the base end and adapted to engage corresponding notches within the cap to affix the nose in one of a plurality of axial positions within the cap.

13. An improved method of caulking comprising providing a caulking gun having a body adapted to receive removable fill material cartridges, the caulking gun having a ratchet operable to urge a plunger against one end of the cartridge to expel fill material from an opposite end of the cartridge;

providing a caddy adapted to be partially and removably received within the body and having two tubular barrels each having an interior surrounding a longitudinal axis extending between a butt end and a nozzle end, the interior adapted to receive a soft-sided refill pack of fill material; and nozzle means on the nozzle end;

a shuttle received within the interior and adapted to engage a butt of a refill pack and to articulate between the butt end and the nozzle end, the shuttle having an annular ring disposed coaxial the barrel and having a shelf end oriented toward the butt end;

a shelf disposed on the shelf end and extending radially inward toward the axis to engage the plunger; and a backbone coupled between the barrels to hold them a spaced distance apart with their axes parallel and with their nozzles disposed in opposite directions; then selecting two soft-sided refill packs; then opening one end of each of the refill packs to enable material inside to escape when urged to do so; then removing the nozzle means from each of the barrels; then inserting the butt of one of the refill packs into each of the barrels through the nozzle end and urging the shuttle toward the butt end of the barrel until the refill pack is entirely received within the barrel; then replacing the nozzle means onto each of the barrels; then (a) inserting a first one of the barrels into the body with its butt end adjacent the ratchet; then (b) inserting the plunger coaxially into the butt end of the first one of the barrels until it engages the shuttle shelf therein; then (c) operating the ratchet to urge the plunger against the shuttle and the butt of the refill pack to expel a bead of fill material through the nozzle means; then (d) retracting the plunger from the first one of the barrels to relieve pressure on the refill pack; then removing the first one of the barrels from the body and rotating the caddy to insert a second one of the barrels into the body with its nose; then repeating steps (a) through (d) above for the second one of the barrels.

14. The improved method of claim 13 wherein the nozzle means comprises a cap journaled onto the nozzle end of the barrel and adapted to rotate about the axis between a plurality of axial positions, the cap having a plurality of position marks disposed parallel the axis on an exterior surface of the cap, the marks adapted to align with a position arrow on an exterior surface of the barrel; and a truncated, conical nose received within the cap and having a base end opposite a bead end, the bead end forming a bead aperture;

a plurality of longitudinal vanes disposed around the base end and adapted to engage corresponding notches within the cap to affix the nose in one of a plurality of axial positions within the cap.

15. The improved method of claim 14 wherein the method comprises the following additional steps carried out as needed between steps (a) and (b):

(a1) lifting the nose out of the body to provide access to the cap; and (a2) rotating the cap to one of the plurality of axial position marks to position the bead aperture to a preferred angle about the axis.

16. The improved method of claim 13 and further comprising the steps of providing a smoothing tool having two smoothing spoons on opposite ends of an elongate handle; and a ferrous metal portion journaled within a recess in the handle;

providing magnetic means within the backbone for attracting and removably holding the smoothing tool to the backbone; then selectively and repetitively, for a plurality of times for each barrel, carrying out the following steps between steps (b) and (c):

(b1) removing the smoothing tool from the backbone;

(b2) grasping the handle and employing the smoothing spoons to smooth the bead of fill material to a desired uniformity and shape; and (b3) replacing the smoothing tool onto the backbone for storage thereof using the magnetic means.

* * * * *